US006612945B1

(12) United States Patent
Anderson

(10) Patent No.: US 6,612,945 B1
(45) Date of Patent: Sep. 2, 2003

(54) MULTIPLE WALL METAL BAT HAVING INDEPENDENT OUTER WALL AND TEXTURED INNER WALL

(76) Inventor: Steven L. Anderson, 321 Avocado St. #D, Costa Mesa, CA (US) 92627

( * ) Notice: Subject to any disclaimer, the term of this patent is extended or adjusted under 35 U.S.C. 154(b) by 0 days.

(21) Appl. No.: 10/072,151

(22) Filed: Feb. 11, 2002

(51) Int. Cl.[7] ..... A63B 59/06
(52) U.S. Cl. ..... 473/566
(58) Field of Search ..... 473/564–568, 473/519, 520, 457

(56) References Cited

U.S. PATENT DOCUMENTS 3,963,239 A * 6/1976 Fujii ..... 473/566
5,676,610 A * 10/1997 Bhatt et al. ..... 473/566
6,143,429 A * 11/2000 Abkowitz et al. ..... 473/566
6,176,795 B1 * 1/2001 Schullstrom ..... 473/566
6,287,222 B1 * 9/2001 Pitsenberger ..... 473/566
6,425,836 B1 * 7/2002 Misono et al. ..... 473/567
6,461,260 B1 * 10/2002 Higginbotham ..... 473/566
6,482,114 B1 * 11/2002 Eggiman et al. ..... 473/566

* cited by examiner

*Primary Examiner*—Mark S. Graham
(74) *Attorney, Agent, or Firm*—Morland C. Fischer

(57) ABSTRACT

A multi-wall bat of the type used for playing baseball or softball. The bat includes a hollow metallic inner wall having a spiral textured surface and a hollow metallic outer wall surrounding the inner wall. The outer wall lies against the spiral textured surface of the inner wall, whereby the area of contact between the inner and outer walls of the bat is minimized. By virtue of the precise and constant contact between the outer wall and the raised peaks of the textured surface of the inner wall, the inner and outer walls are adapted to flex both independently of and simultaneously with each other in response to a ball striking the bat. One of the inner or outer walls is capable of being slidably displaced relative to the other wall in response to a ball striking the bat.

20 Claims, 4 Drawing Sheets

MULTIPLE WALL METAL BAT HAVING INDEPENDENT OUTER WALL AND TEXTURED INNER WALL

BACKGROUND OF THE INVENTION

1. Field of the Invention

This invention relates to a metallic multi-wall baseball or softball bat that is characterized by an increased elasticity and hitting performance by virtue of a textured inner wall that is located in minimum but constant face-to-face contact with an outer wall such that the inner and outer walls of the bat are adapted to flex both independently of and simultaneously with one another.

2. Background Art

Metal bats have long been used to play baseball and softball. In order to increase the power that is generated during a batter's swing for driving a ball a greater distance, some metal bats have a double walled barrel. That is to say, the barrel area of the bat is formed by inner and outer metal shells that cooperate to maximize the impact force between the bat and the ball.

However, the inner and outer barrel shells of the conventional multi-wall metal bats are typically fixed to one another such that one shell cannot move relative to the other. Consequently, the inner and outer shells do not flex independently of one another in response to a ball striking the barrel, whereby to limit the hitting performance of the bat. More particularly, to generate maximum power using a conventional multi-wall bat, the ball must strike the heart of the sweet spot, typically at the center of the barrel. In cases where the ball strikes the barrel at a location other than the sweet spot, energy will be lost such that the travel of the ball following impact will be reduced. Therefore, such conventional multi-wall metal bats having a limited hitting area have proven to be inefficient whenever the ball is struck off-center.

Examples of multi-wall metal bats having a barrel configuration with inner and outer walls are available by referring to the following United States Patents:

| | | |
|---|---|---|
| 5,415,398 | Eggiman | May 16, 1995 |
| 5,722,908 | Feeney | Mar. 3, 1998 |
| 5,899,823 | Eggiman | May 4, 1999 |
| 6,053,828 | Pitsenberger | Apr. 25, 2000 |
| 6,159,116 | Pitsenberger | Dec. 12, 2000 |

However, it may be appreciated that the inner and outer barrel walls of the conventional multi-wall bats do not flex both independently and simultaneously relative to one another. As a result of their confining configurations, the inner and outer barrel walls of these bats either flex independently (e.g. U.S. Pat. Nos. 5,415,398 and 5,899,823) because of a continuous gap between the walls or simultaneously (e.g. U.S. Pat. Nos. 6,053,828 and 6,159,116) because of a uniformly continuous contact between the walls.

SUMMARY OF THE INVENTION

A multi-wall, metal bat is disclosed herein which is of the kind to be used for playing baseball or softball. According to a first embodiment, the bat includes a hollow metallic outer shell having a relatively wide barrel at one end thereof, a relatively narrow handle at the opposite end, and a tapered intermediate portion running between the barrel and the handle. Located inside the hollow outer shell in opposing facing alignment with the barrel is a metallic tubular sleeve insert having a textured exterior surface. A high density elastomeric center core at the end of the tubular sleeve insert is surrounded by and mechanically locked to a ring-like metallic end cap. The textured tubular sleeve insert includes a set of preformed spirals that are formed by swaging and pulling an aluminum tube. The tubular sleeve insert maximizes the strength of the barrel while the set of spirals of the tubular sleeve insert limit the points of contact between the insert and the barrel. By virtue of the foregoing, the tubular sleeve insert and the outer shell are adapted to flex both independently of and simultaneously with one another in response to an impact force created when a ball strikes the bat.

In addition, the tubular sleeve insert will move a limited distance in a forward direction through the hollow outer shell relative to the barrel and towards the end cap, whereby the hitting area of the bat is effectively extended to any location along the barrel. In this regard, a set of spring-like positioning pins fixedly connect the barrel, the end cap and the center core to one another. However, the tubular sleeve insert has a corresponding set of oversized pin holes that receive respective ones of the positioning pins so that the tubular sleeve insert is free to slide through the hollow outer shell relative to the aforementioned connection of the barrel, the end cap and center core. Accordingly, the bat of this invention offers improved elasticity and hitting performance over conventional multi-wall metal bats having inner and outer walls that either are fixedly connected together or separated from one another by a continuous gap.

According to a second embodiment of this invention a multi-wall metal bat is disclosed including an inner shell having a wide barrel at one end thereof, a narrow handle at the opposite end, and a tapered intermediate portion running between the barrel and the handle. The barrel of the inner shell has a textured (e.g. preformed spirals) exterior surface that is surrounded by an outer sleeve. A high density elastomeric center core at the end of the barrel of the inner shell is surrounded by and mechanically locked to a ring-like metallic end cap. The opposite facing textured barrel of the inner shell and the outer sleeve lie in limited contact with one another, whereby the outer sleeve and the inner barrel are adapted to flex both independently of and simultaneously with one another in response to an impact force. The outer sleeve, end cap and elastomeric center core are all connected together by a set of spring-like positioning pins that are received through oversized pin holes in the barrel. Accordingly, the combination of the outer sleeve, end cap and center core are free to slide a limited distance in a forward direction relative to the barrel of the inner shell.

DETAILED DESCRIPTION

Figure 1:
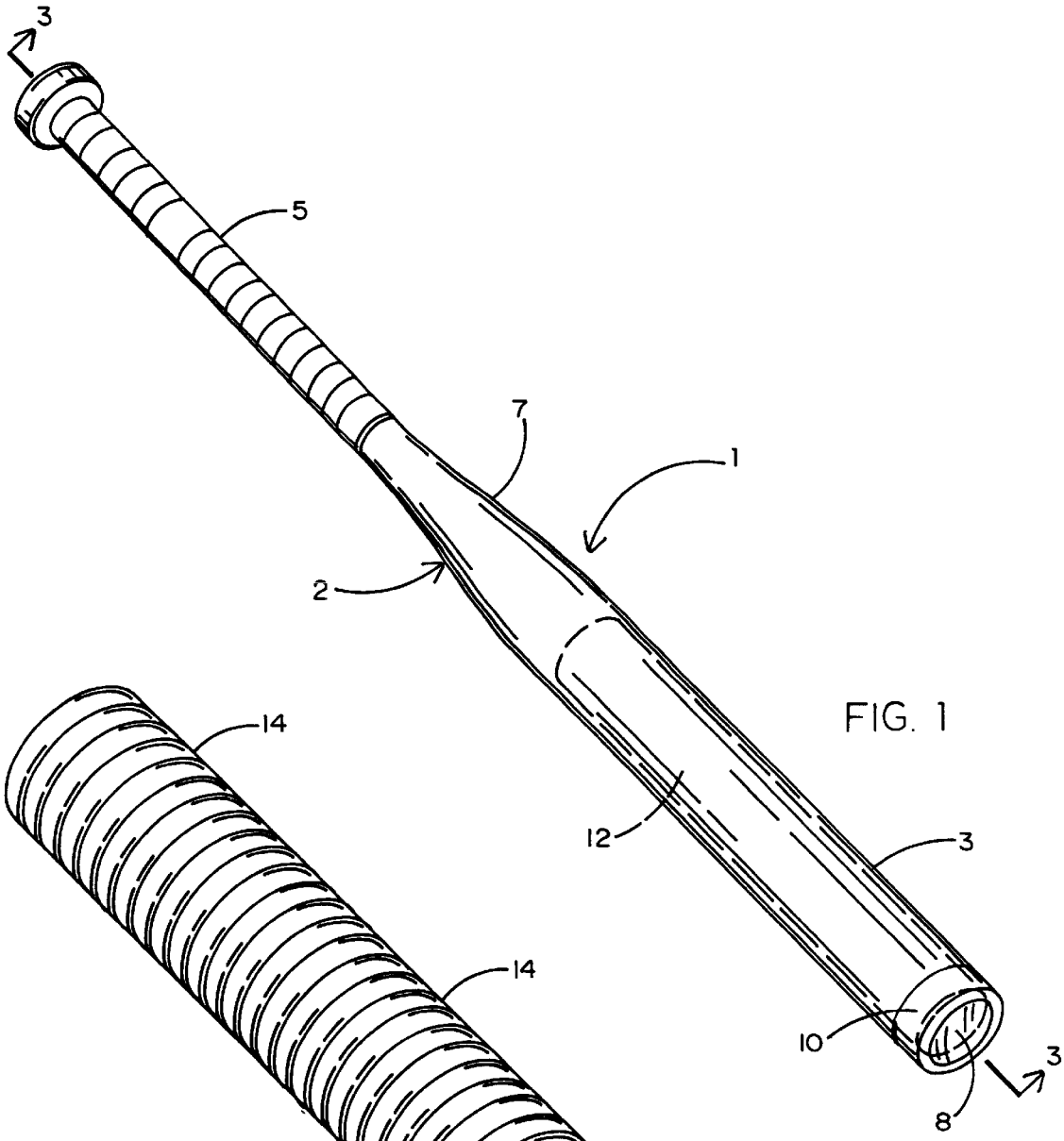
FIG. 1 shows the multi-wall metal baseball bat which forms a first embodiment of the present invention having a textured tubular sleeve insert lying in opposing facing alignment with an outer shell of the bat.

The multi-wall baseball bat I which forms a first embodiment of the present invention is described while initially referring to FIG. 1 of the drawings. The multi-wall bat 1 has a hollow outer shell 2 that is preferably manufactured from aluminum or any other suitable metal. Although the bat 1 will be described herein as a baseball bat, it is to be understood that the bat can also be used for playing softball. Like conventional baseball bats, the bat 1 shown FIG. 1 includes a relatively wide tubular barrel 3 at one end thereof for striking a baseball or a softball, a narrow tubular handle 5 at the opposite end at which to grip the bat, and a tapered intermediate portion 7 running between the barrel 3 and the handle 5. The end of the hollow outer shell 2 of baseball bat 1 at which the barrel 3 is formed is closed by the receipt of a high density elastomeric (e.g. polyurethane) center core 8 that is surrounded by a ring-like end cap 10 to add weight to the barrel. The center core 8 and the end cap 10 are manufactured as a sub-assembly that is fitted to the barrel 3 by a light interference fit. Means by which the center core 8 and the end cap 10 sub-assembly are attached to one another at the end of the barrel 3 will be described in greater detail hereinafter when referring to FIGS. 3 and 5.

Figure 2:
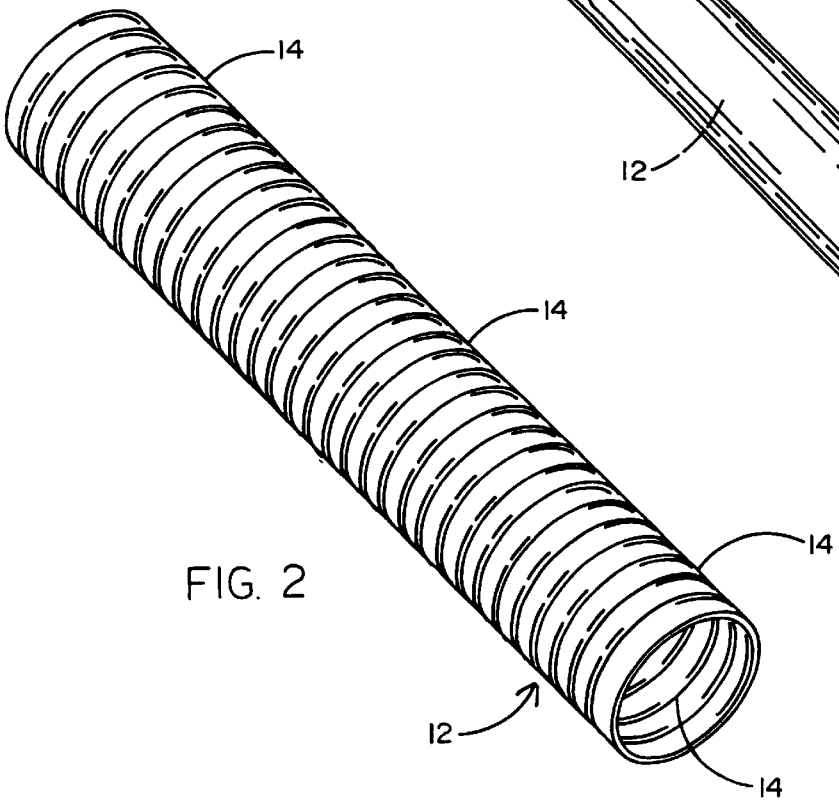
FIG. 2 illustrates the textured tubular sleeve insert that is located in opposing facing alignment with the outer shell of the bat of FIG. 1.

In accordance with the improvement to the first embodiment of this invention which enhances the hitting performance of the baseball bat 1, a hollow tubular sleeve insert 12 is located within and moveable through the hollow outer shell 2. More particularly, and turning to FIGS. 2–4 of the drawings, the tubular sleeve insert 12 is of sufficient length to lie in opposing facing alignment with the barrel 3 of bat 1. At least the exterior surface of the tubular sleeve insert 12 includes a set of preformed spirals 14 running longitudinally therealong. The set of preformed spirals 14 may be formed by any suitable manufacturing process such as, for example, subjecting an aluminum tube to a swaging and pulling technique. Because of the swaging and pulling process, spirals 14 can be formed at opposite faces of the tubular sleeve insert 12, whereby the opposing arch geometry advantageously strengthens insert 12 and improves the elastic characteristics thereof.

Figure 4:
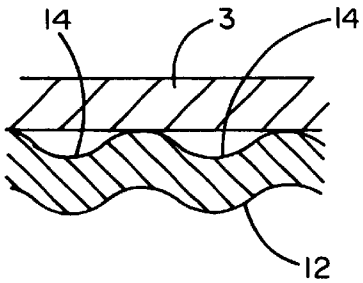
FIG. 4 shows an enlarged detail of the interface between the textured tubular sleeve insert and the oppositely facing outer shell of the baseball bat of FIG. 3.

The set of spirals 14 provide the tubular sleeve insert 12 with a textured surface. Thus, and as is best shown in FIG. 4, the spiral wrapped tubular sleeve insert 12 will not lie uniformly flush against the opposing barrel 3 of baseball bat 1. That is, the only contact points between the tubular sleeve insert 12 and the tubular barrel 3 will occur at the peaks of the spirals 14. Hence, it may be appreciated that the spiral wrapped tubular sleeve insert 12 reinforces the barrel 3 in order to provide maximum strength but minimum contact with the outer shell 2 of baseball bat 1. What is even more, and as an important advantage of the improved multi-wall bat configuration of this invention over conventional multi-walled bat configurations, the spiral wrapped tubular sleeve insert 12 is adapted to flex both independently of and simultaneously with the opposing barrel 3. In this regard, the spiral wrap can be replaced by other textures (e.g. independent, parallel aligned rings) which provide minimum contact between the outer barrel 3 and inner sleeve insert 12 to preserve the ability of the inner sleeve insert 12 to flex independently of and simultaneously with the outer barrel 3 of the multi-walled bat 1.

In other words, the multi-wall bat configuration disclosed herein provides a controlled breach of contact of the outer barrel 3 and the inner sleeve insert 12 at prescribed intervals (i.e. the empty valleys located between the peaks of spiral textured insert 12). This allows the inner and outer walls 12 and 3 to flex independently by providing an area of the inner wall 12 within which the outer wall will be displaced. At the same time, the inner and outer walls 12 and 3 are also forced to flex simultaneously as a result of the precise and unbroken contact at the spaced interface established between the peaks of the spiral textured inner wall 12 against the outer wall 3. At no time will the inner and outer walls 12 and 3 respond sequentially, nor can they converge to make new contact points during impact with a ball.

Figure 3:
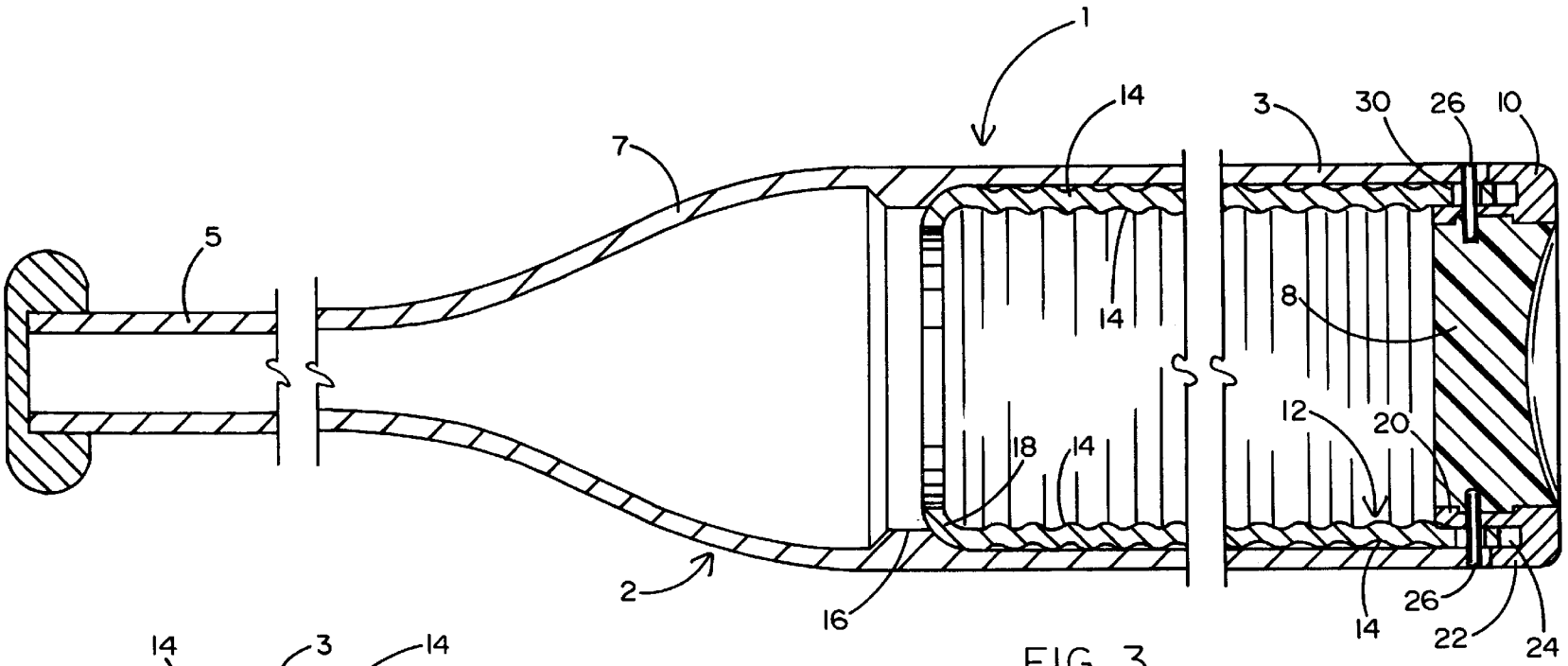
FIG. 3 is a cross-section of the multi-wall baseball bat while at rest taken along lines 3—3 of FIG. 1.

A preformed annular buttress 16 projects radially inward from the outer shell 2 at the intersection of the barrel 3 with the intermediate portion 7. As is best shown in FIG. 3, the preformed annular buttress 16 is a thick wall area that reinforces the outer shell 2 at the transition of the intermediate portion 7 to the multi-wall barrel 3. In the assembled bat configuration, the tubular sleeve insert 12 is seated against the annular buttress 16 to facilitate the assembly of end cap 10 and center core 8.

To this end, the spiral wrapped tubular sleeve insert 12 is provided with a preformed rounded or rolled over lip 18. The rounded lip 18 projects radially inward from the sleeve insert 12 to establish an area of increased structural strength that is shaped so as to be received against the radially inward projecting buttress 16 of outer shell 2, whereby the barrel 3 and tubular sleeve insert 12 will be aligned during manufacture of the baseball bat 1. However, and as will now be described, the tubular sleeve insert 12 is able to move a short distance in a forward direction through the hollow outer shell 2 away from buttress 16 and towards the end cap 10.

Figure 5:
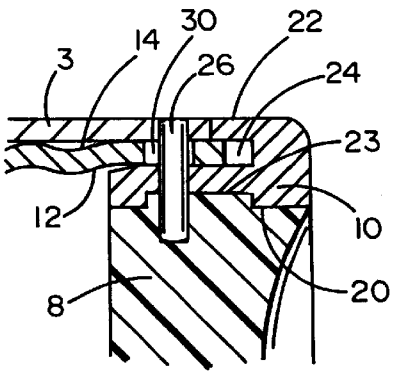
FIG. 5 shows an enlarged detail of the baseball bat of FIG. 3.

As previously disclosed, the barrel end of the hollow outer shell 2 of baseball bat 1 is closed by the receipt therewithin of a sub-assembly comprising a weighted elastomeric center core 8 that is surrounded by a ring-like end cap 10. As is best shown in FIGS. 3 and 5 of the drawings, means are provided for attaching the outer shell 2, the end cap 10 and the center core 8 to one another while permitting the tubular sleeve insert 12 to be capable of limited free movement in the forward direction through the outer shell 2 and relative to the barrel 3 of bat 1. To accommodate the foregoing, the inner tubular sleeve insert 12 is slightly longer than the barrel portion 3 of outer shell 2.

More particularly, and referring concurrently to FIGS. 3 and 5, the end cap 10 is preferably a rigid structural ring-like member that is manufactured from machined aluminum, or the like. End cap 10 has a generally U-shaped cross-section formed by inner and outer walls 20 and 22 that are spaced from one another by a gap 24 located therebetween. A circumferentially extending seat 23 (best shown in FIG. 5) is formed in the inner wall 20 of end cap 10. To complete the sub-assembly, the center core 8 is surrounded by and mechanically locked in place at the inner wall 20 of the end cap 10 by filling the circumferentially extending seat 23 thereof. The tubular sleeve insert 12 is initially positioned so as to partially fill the gap 24 between the inner and outer walls 20 and 22 of the end cap 10. During assembly of the bat 1, the outer wall 22 of end cap 10 is positioned against the butt end of the barrel 3 of outer shell 2.

A set of (e.g. three) positioning pins (e.g. flexible spring steel roll pins) 26 are spaced from one another at equal distances (e.g. at 120 degree intervals) around the outer shell 2 of baseball 1 so as to extend through each of the barrel 3, the spiral wrapped tubular sleeve insert 12, the inner wall 20 of the end cap 10, and the center core 8. However, the positioning pins 26 are also received through respective oversized pin holes 30 that are formed in the tubular sleeve insert 12. Thus, while the positioning pins 26 fix the positions of the barrel 3, the end cap 10 and the center core 8 of baseball bat 1 relative to one another, the tubular sleeve insert 12 is adapted to float within the hollow outer shell 2 so as to move a short distance and thereby completely fill the gap 24 of end cap 10.

FIGS. 3 and 5 show the baseball bat 1 in the at-rest position with no impact force being applied to the barrel 3. In this case, the spiral wrapped tubular sleeve insert 12 is located rearwardly within the hollow outer shell 2, whereby the rolled lip 18 of tubular sleeve insert 12 is seated against the radially inward extending buttress 16. Correspondingly, the spring-like positioning pins 26 extend through first ends of the pinholes 30 so that the aforementioned gap 24 between the end of the tubular sleeve insert 12 and the end cap 10 remains partially empty.

When an impact force (e.g. a baseball) strikes the barrel 3 of baseball bat 1, the barrel 3 and the spiral wrapped tubular sleeve insert 12 will flex independently and simultaneously as previously described. In addition, the spiral wrapped tubular sleeve insert 12 will move momentarily off the buttress 16 so as to slide forwardly through the hollow outer shell 2 by approximately 0.002 inches towards end cap 10. The positioning pins 26 are now located at the opposite ends of the oversized pin holes 30, and the gap 24 is completely filled (not shown) by the forward moving tubular sleeve insert 12, whereby to limit the movement of insert 12. When the impact force dissipates, the resilient nature of the positioning pins 26 causes the tubular sleeve insert 12 to automatically recover to its at-rest position of FIGS. 3 and 5.

FIGS. 1–5 show a baseball bat 1 wherein an inner spiral wound tubular sleeve insert 12 is located inside the hollow outer shell 2 to form a multi-wall barrel 3. In accordance with a second embodiment of this invention, and turning to FIG. 6 of the drawings, a multi-wall baseball bat 31 having improved hitting characteristics is described wherein an aluminum outer sleeve 42 lies in opposing facing alignment with a hollow inner aluminum shell 32. A wide tubular barrel 33 is located at one end of the inner shell 32 so as to lie adjacent the outer sleeve 42, a narrow tubular handle 35 is located at the opposite end of the shell, and a tapered intermediate portion 37 runs between the barrel 33 and the handle 35. The barrel end of the bat 31 is closed by an elastomeric center core 38 that is surrounded by and mechanically locked to a ring-like end cap 40. The center core 38 and end cap 40 are manufactured as a sub-assembly that is fitted to the end of the barrel 33 by a light interference fit.

The barrel 33 of hollow inner shell 32 is provided with a textured surface by means of a swaging and pulling process, or any other suitable technique. Therefore, like the tubular sleeve insert 12 of baseball bat 1, the hollow shell 32 is wrapped by a set of preformed spirals 44 on opposite faces thereof. As earlier described, spirals 44 are formed at opposite faces of the hollow shell 42 following the swaging process to take advantage of the opposing arch geometry as a result thereof. Moreover, the spirals 44 which wrap the barrel 33 of hollow shell 32 can be replaced by other textures so long as a uniformly spaced, point-to-point contact is maintained between raised peaks of the textured surface of the inner hollow shell 32 and the opposing outer sleeve 42.

The outer sleeve 42 of baseball bat 1 is a hollow tube that is manufactured from aluminum, or any other suitable light weight metal. The outer sleeve 42 has a diameter by which to surround the spiral wrapped barrel 33 of the hollow shell 32. A protective elastomeric seal 48 is located around the seam at the interface of the spiral textured inner shell 32 with one end of the outer sleeve 42. The elastomeric seal 48 also keeps moisture and dirt from entering the seam between the inner shell 32 and outer sleeve 42. As will soon be described, the sub-assembly comprising the center core 38 and the end cap 40 is attached to the other end of the outer sleeve 42.

By virtue of the outer sleeve 42 surrounding the spiral textured barrel 33 of inner shell 32 so as to lie in a precise and unvarying contact therewith at the peaks of spirals 44, the outer sleeve 42 and the inner shell 32 are capable of flexing both independently of one another (as the outer sleeve 42 is forced into the valleys of the spirals 44 of inner shell 32) and simultaneously with one another (at the unbroken contact points where the raised peaks of spirals 44 continuously engage the outer sleeve 42) to achieve the same advantages that were also achieved by the baseball bat 1 of FIGS. 1–5.

Like the end cap 10 of baseball bat 1, the end cap 40 of bat 31 is a rigid metal ring-like member having a U-shaped cross-section formed by inner and outer walls 50 and 52 that are spaced from one another by a gap 54. A circumferentially extending seat 53 is formed in the inner wall 50 of end cap 40. To complete the end cap sub-assembly, the center core 38 is surrounded by and mechanically locked in place at the inner wall 50 of end cap 10 by filling the circumferentially extending seat 53 thereof. In this second embodiment, the hollow inner shell 32 is positioned relative to the end cap 40 so as to be slidably received in the gap 54 between the inner and outer walls 50 and 52.

A set of (e.g. three) flexible, spring steel positioning pins 56 are equally spaced from one another around the bat 31 so as to extend through the outer sleeve 42, the inner wall 50 of end cap 40 and the center core 38. The positioning pins 56 are also received through respective oversized pin holes 60 that are formed in the spiral textured inner shell 32. Thus, while the positioning pins 56 fix the position of the outer sleeve 42 and the sub-assembly comprising the end cap 40 surrounding the center core 38, the aforementioned combination is capable of limited free movement relative to the inner shell 32.

Figure 6:
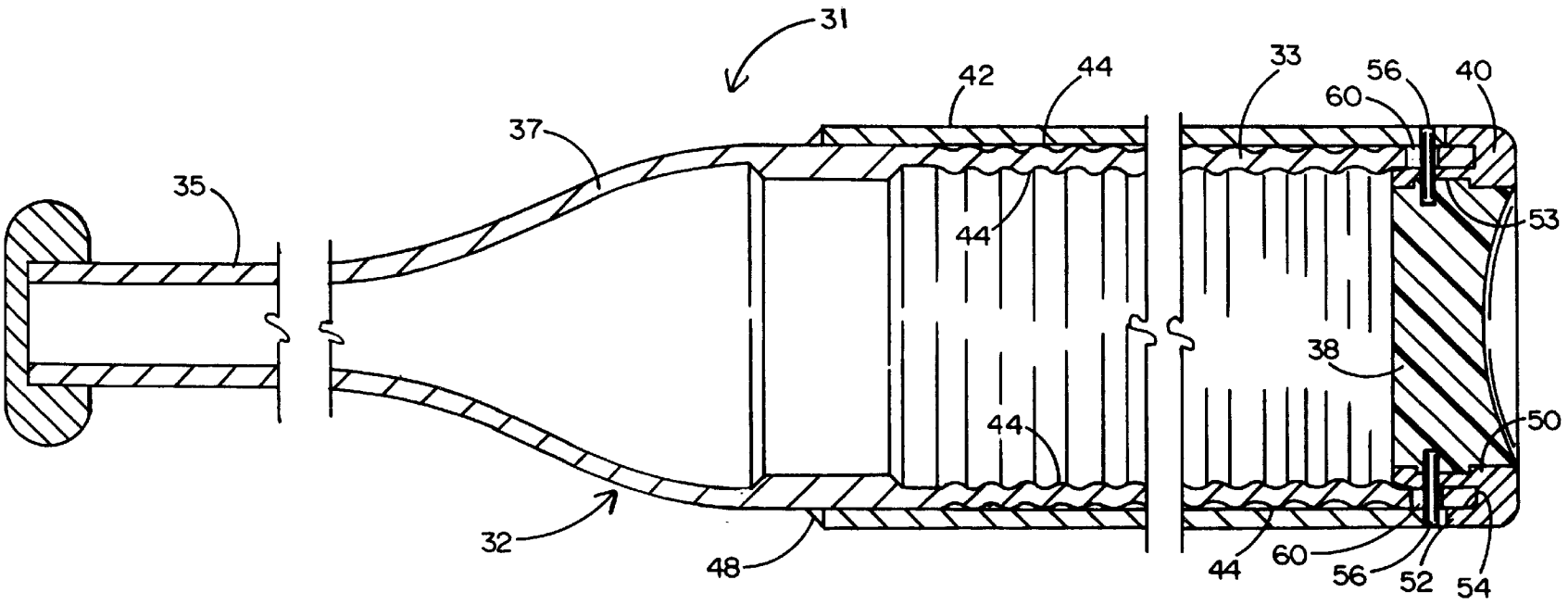
FIG. 6 is a cross-section of a multi-wall baseball bat which forms a second embodiment of the present invention having an outer sleeve lying in opposing facing alignment with a textured inner shell of the bat.

More particularly, with the baseball bat 31 at rest, as shown in FIG. 6, and with no impact forces being applied to the barrel 33, the end cap 40 initially lies in close surrounding engagement with the barrel end of the spiral wrapped inner shell 32 such that inner shell 32 completely fills the gap 54 between the inner and outer walls 50 and 52 of end cap 40. The flexible positioning pins 56 located at first ends of the oversized pin holes 60.

When an impact force (e.g. a baseball) strikes the outer sleeve 42, the inner shell 32 and the outer sleeve 42 will flex independently and simultaneously, as previously described. In addition, the center core 38, end cap 40 and outer sleeve 42 (which are fastened together by means of positioning pins 56) will momentarily slide together over the spiral wrapped inner shell 32 for a distance of approximately 0.002 inches in a forward direction away from the handle 35 of shell 32. The positioning pins 56 will now be located at opposite ends of the pinholes 30 so as to limit the forward sliding movement of center core 38, end cap 40 and outer sleeve 42 over inner shell 32. The gap 54 between the inner and outer walls 50 and 52 of end cap 40 will be partially empty (not shown) as the end cap 40 slides forwardly and away from the barrel 33 of inner shell 32. When the impact force dissipates, the spring-like nature of the positioning pins 56 causes the combination of center core 38, end cap 40 and outer sleeve 42 to automatically recover to their at-rest position shown in FIG. 6.

Figure 7A:
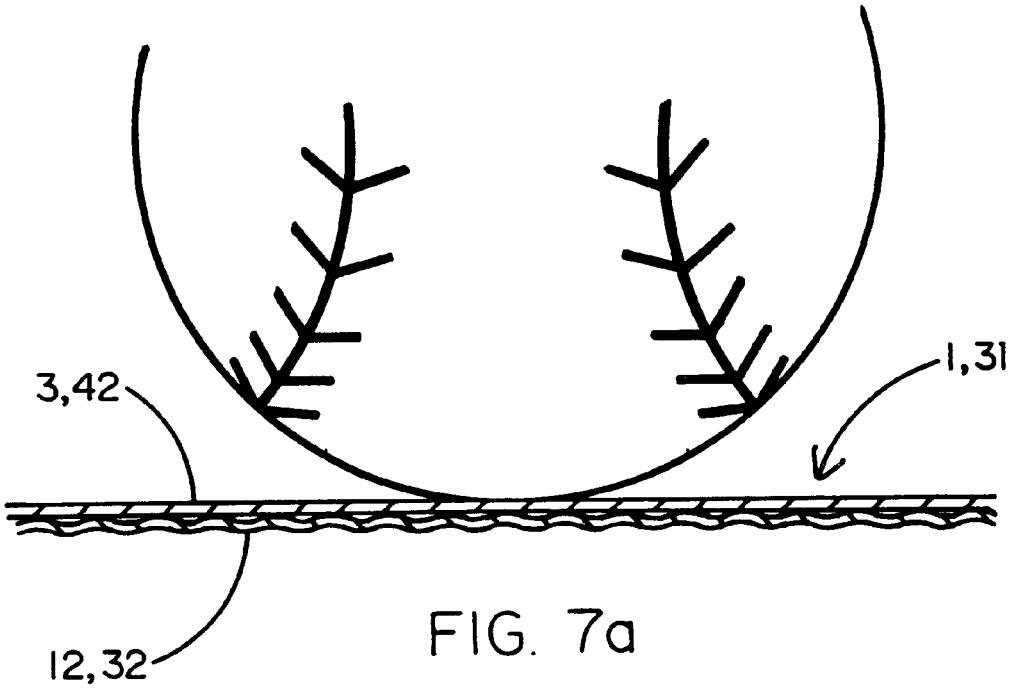
FIGS. 7*a* and 7*b* show the multi-wall baseball bats of FIGS. 1 and 6 with the barrels thereof at rest and at maximum flex in response to an impact force generated by a baseball or a softball.
Figure 7B:
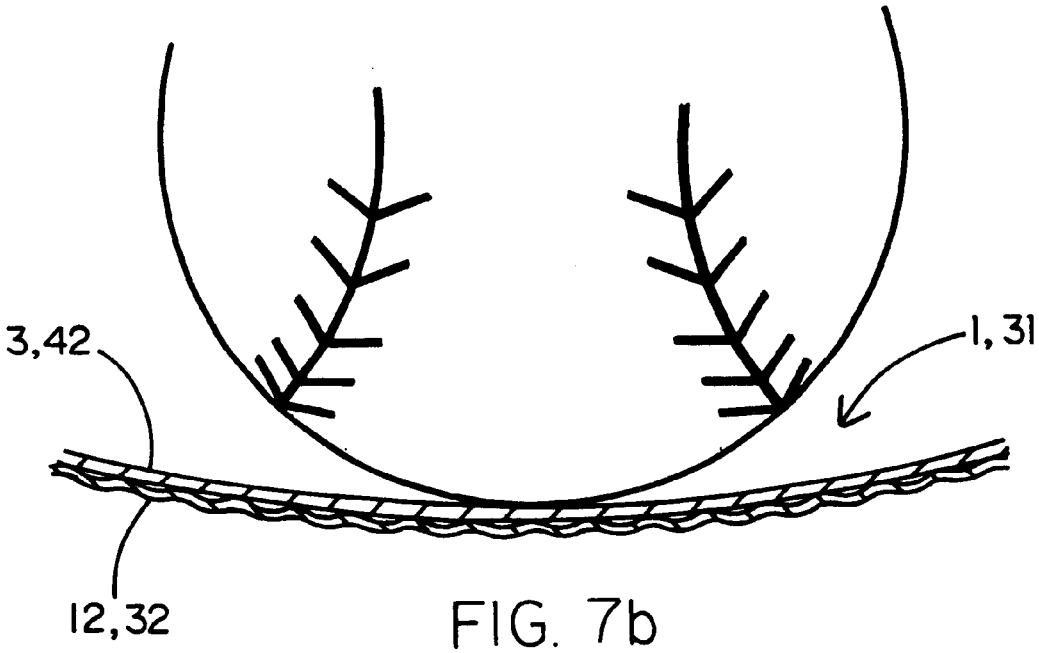

By virtue of the outer walls 3 and 42 flexing independently of and simultaneously with the spiral wrapped inner walls 12 and 32, the baseball bats 1 and 31 of this invention are provided with a symmetrical flexing characteristic. FIG. 7*a* shows the inner and outer barrel walls of the bats 1 and 31 at equilibrium prior to an impact force (e.g. a ball) striking the outer barrel walls 3 or 42 thereof. As shown in FIG. 7*b*, once the ball strikes the outer barrel wall 3 or 42, the barrels of the bats 1 and 31 will fully respond to the impact force regardless of where the ball strikes the barrel. Such symmetrical flexing creates a larger hitting area so as to extend the sweet spot of the bat to effectively encompass the entire barrel. By providing the inner barrel walls 12 and 32 with a textured surface that maintains a continuous but minimum contact with the outer barrel walls 3 and 42, the bats 1 and 31 of this invention are stronger and lighter than conventional multiple wall metal baseball bats wherein the walls thereof are either fixedly retained or substantially inflexible relative to one another. Accordingly the baseball bats 1 and 31 of this invention advantageously offer improved elasticity and hitting performance over such conventional bats.

I claim:

1. A bat for playing softball or baseball and comprising:

a hollow metallic outer shell having a relatively wide barrel at which to strike a ball, a relatively narrow handle at which to grip the bat, and an intermediate portion running between the barrel and the handle;

a tubular metallic sleeve insert located inside said hollow outer shell and lying against the barrel thereof, said tubular sleeve insert and the barrel adapted to flex independently of and simultaneously with one another in response to an impact force that is generated when a ball strikes the bat at the barrel of said outer shell; and an end cap attached to said hollow outer shell at the barrel thereof, said tubular sleeve insert adapted to move through said hollow outer shell and relative to the barrel in a direction towards said end cap in response to a ball striking the bat.

2. The bat recited in claim 1, wherein said tubular sleeve insert includes a textured exterior surface by which to minimize the area of contact between said tubular sleeve insert and the barrel of said hollow outer shell.

3. The bat recited in claim 2, wherein the textured exterior surface of said tubular sleeve insert is a spiral wrap.

4. The bat recited in claim 3, wherein said spiral wrapped tubular sleeve insert is manufactured by subjecting a hollow metal tube to a swaging and pulling process, the length of said metal tube being longer than the length of the barrel of said hollow outer shell.

5. The bat recited in claim 1, further comprising an elastomeric core attached to said end cap so as to extend across the tubular sleeve insert, said end cap comprising a ring for surrounding said elastomeric core and having a recess extending circumferentially therearound within which said elastomeric core is seated to attach said elastomeric core to said ring.

6. The bat recited in claim 1, further comprising a buttress projecting inwardly from said hollow outer shell so as to engage said tubular sleeve insert and thereby position said tubular sleeve insert for movement through said hollow outer shell.

7. The bat recited in claim 6, wherein said tubular sleeve insert has a radially inward projecting lip formed at one end thereof to be engaged by said inwardly projecting buttress so as to position said tubular sleeve insert for movement through said hollow outer shell.

8. The bat recited in claim 1, wherein said end cap includes an inner wall, an outer wall and a gap located between said inner and outer walls, said tubular sleeve insert adapted to move through said hollow outer shell and relative to the barrel thereof, so as to slide through the gap between said inner and outer walls.

9. The bat recited in claim 1, further comprising at least one fastener by which to fixedly connect the end cap and the barrel of said hollow outer shell to one another so that said tubular sleeve insert is moveable relative thereto.

10. The bat recited in claim 9, wherein said tubular sleeve insert has a hole formed therein through which said at least one fastener is received to connect the end cap and the barrel of said hollow outer shell to one another, said hole being of sufficiently large size to permit said tubular sleeve insert to move relative to said fastener and to the connection of the end cap to the barrel of said hollow outer shell.

11. The bat recited in claim 9, wherein said at least one fastener is a flexible pin having a spring characteristic.

12. A bat for playing baseball or softball and comprising:

a hollow metallic inner shell having a relatively wide barrel, a relatively narrow handle at which the bat is gripped and a tapered intermediate portion running between the barrel and the handle, the barrel of said inner shell having a textured surface; and a metallic outer sleeve surrounding said inner shell and lying against the textured surface of said barrel, the textured surface minimizing the area of contact between said outer sleeve and said barrel, such that said outer sleeve and said barrel are adapted to flex independently of and simultaneously with one another in response to an impact force that is generated when a ball strikes the bat at said outer sleeve thereof.

13. The bat recited in claim 12, wherein the textured surface of the barrel of said hollow inner shell is a spiral wrap.

14. The bat recited in claim 12, further comprising an end cap attached to said hollow inner shell at the barrel thereof and an elastomeric core attached to said end cap so as to extend across the barrel, said end cap comprising a ring for surrounding said elastomeric core and having a recess extending circumferentially therearound within which said elastomeric core is seated to attach said elastomeric core to said ring.

15. The bat recited in claim 14, wherein said end cap includes an inner wall, an outer wall and a gap located between said inner and outer walls, the barrel of said hollow inner shell received within said gap between the inner and outer walls of said end cap.

16. The bat recited in claim 14, further comprising at least one fastener by which to fixedly connect the end cap, the elastomeric core and the outer sleeve to one another.

17. The bat recited in claim 16, wherein said hollow inner shell has a hole formed therein through which said at least one fastener is received to connect the end cap, the elastomeric core and the other sleeve to one another, said hole being of sufficiently large size to permit the connection of said end cap, said elastomeric core and said outer sleeve to move relative to said hollow inner shell.

18. The bat recited in claim 16, wherein said at least one fastener is a flexible pin having a spring characteristic.

19. The bat recited in claim 18, wherein said flexible pin received through the hole formed in said hollow inner shell enables the connection of said end cap, said elastomeric core and said outer sleeve to slide back and forth over the barrel of said hollow inner shell.

20. A bat for playing softball or baseball and comprising:

a hollow outer shell having a relatively wide barrel at which to strike a ball, a relatively narrow handle at which to grip the bat, and an intermediate portion running between the barrel and the handle; and a tubular sleeve insert located inside said hollow outer shell and lying against the barrel at a first end thereof, said tubular sleeve insert having a textured outer surface by which to minimize the area of contact between said tubular sleeve insert and the barrel of said hollow outer shell, said tubular sleeve insert and the barrel adapted to flex independently of and simultaneously with one another in response to an impact force that is generated when a ball strikes the bat at the barrel of said outer shell, and said tubular sleeve insert also adapted to move longitudinally through said hollow outer shell from the first end of said barrel to the opposite end of said barrel in response to a ball striking the bat.

* * * * *